US006672581B2

(12) United States Patent
Lee et al.

(10) Patent No.: US 6,672,581 B2
(45) Date of Patent: Jan. 6, 2004

(54) SHEET CONVEYING APPARATUS FOR AN IMAGE INFORMATION PROCESSOR

(75) Inventors: Yun-Suk Lee, Suwon (KR); Hyun-Cheol Lee, Seoul (KR); Su-In Lee, Sungnam (KR)

(73) Assignee: Samsung Electronics Co., Ltd., Suwon (KR)

( * ) Notice: Subject to any disclaimer, the term of this patent is extended or adjusted under 35 U.S.C. 154(b) by 11 days.

(21) Appl. No.: 09/982,810

(22) Filed: Oct. 22, 2001

(65) Prior Publication Data

US 2002/0117795 A1 Aug. 29, 2002

(30) Foreign Application Priority Data

Feb. 28, 2001 (KR) ..... 2001-10362

(51) Int. Cl.[7] ..... B65H 5/06

(52) U.S. Cl. ..... 271/164; 271/271; 271/4.03; 271/4.04; 271/10.13; 271/242; 271/110

(58) Field of Search ..... 271/4.1, 4.03, 271/4.04, 10.03, 10.04, 10.05, 10.12, 10.13, 110, 242

(56) References Cited

U.S. PATENT DOCUMENTS 5,058,874 A * 10/1991 Miyoshi et al. ..... 271/4.1
5,199,696 A * 4/1993 Kato ..... 271/10.13
5,749,570 A 5/1998 Iwata et al.
5,927,705 A * 7/1999 Becker et al. ..... 271/114
6,334,725 B1 * 1/2002 Miyauchi ..... 400/624
6,352,256 B1 * 3/2002 Hsieh ..... 271/110
6,412,771 B1 * 7/2002 Hirata et al. ..... 271/116
6,439,564 B2 * 8/2002 Andersson et al. ..... 271/10.03
6,485,011 B1 * 11/2002 Yen et al. ..... 271/10.03

* cited by examiner

*Primary Examiner*—Donald P. Walsh
*Assistant Examiner*—Kaitlin Joerger
(74) *Attorney, Agent, or Firm*—Robert E. Bushnell, Esq.

(57) ABSTRACT

A sheet conveying apparatus for an image information processor includes a driving apparatus having a sheet supply opening and a sheet discharge opening arranged above and below and in the same direction, and a registration roller, a delivery roller, a scan roller, and a delivery roller arranged in order along a sheet conveying path formed in an opening curve of a substantially C-shape. The driving apparatus drives the rollers in mutual operations with selective combinations according to a sheet conveying process, and includes a driving motor controlled to change driving modes in the forward and reverse directions, and a power switching device for selectively transferring a rotational force to first and second power transmission systems according to the driving modes of the driving motor, whereby changes in sheet conveying speeds are controlled to secure reliability in the skew-feed correction of a sheet when supplying a large capacity of sheets at a high speed, and to adjust image resolution by mode.

31 Claims, 13 Drawing Sheets

SHEET CONVEYING APPARATUS FOR AN IMAGE INFORMATION PROCESSOR

This application makes reference to, incorporates the same herein, and claims all benefits accruing under 35 U.S.C. §119 from my application SHEET CONVEYING APPARATUS FOR AN IMAGE INFORMATION PROCESSOR filed with the Korean Industrial Property Office on Feb. 28, 2001 and there duly assigned Serial No. 10362/2001.

BACKGROUND OF THE INVENTION

1. Technical Field

The present invention relates to image information processors such as printers, photocopiers, facsimiles, etc. and, more particularly, to a sheet conveying apparatus for an image information processor capable of enhancing accuracy as to skew-feed corrections through control of changing sheet-conveying speeds and also adjusting image resolutions.

2. Related Art

In general, image information processor such as printers, photocopiers, facsimiles, digital multifunction machines having functions of the mentioned devices, etc., convey image information-carrying sheets to an image reader by means of a sheet conveying apparatus having plural rotating rollers. The sheet conveying apparatus has the functions of aligning the leading ends of paper sheets and then correcting skew-feed.

A sheet conveying apparatus for a conventional image information processor includes a sheet separation roller and a sheet guide, oppositely mounted above and below, to separate plural paper sheets stacked on a sheet stacking plate one by one, and to convey the sheets to an image reader.

The image reader reads image information on the sheet through an image reading sensor, and converts an analog signal representing the read image information into a digital signal for output in a state wherein the image reader is elastically biased upwardly by a spring so as to be in close contact with a CS roller oppositely mounted at an upper portion, and the CS roller discharges the paper sheet from which the image reading is completed. A sheet presence/absence detection sensor senses the presence and absence of paper sheets loaded in the sheet stacking plate, and outputs information as to the sensed state as a signal, while a sheet leading end detection sensor senses the leading ends of paper sheets conveyed to the image reader, and outputs the sensed information as a signal.

The sheet leading end detection sensor outputs a control signal for matching an image reading area start point of a paper sheet with the time that the image reader starts to read in image information, and outputs a control signal to change the driving mode of a driving motor from a forward direction to a reverse direction, or vice versa, so as to interactively drive the sheet separation roller and the CS roller.

The sheet conveying apparatus for a conventional image information processor having the above structure, as disclosed in detail in U.S. Pat. No. 5,749,570 to Iwata et al., entitled SHEET CONVEYING APPARATUS issued on May 12, 1998, aligns the leading ends of paper sheets by using the changes of the forward and reverse directions of a driving motor and a mechanical timer mechanism (delay means) to thereby correct the skew-feed of the paper sheets.

Accordingly, there exists a problem in that the sheet conveying apparatus for the conventional image information processor having the above structure requires precision as to operational controls due to the complexity of the mechanism itself, and, in particular, the apparatus has difficulties in securing reliability with respect to precise control when supplying paper sheets at a high speed since the sheet conveying apparatus corrects the skew-feed of the sheets by instantly stopping, and then rotating the CS roller by using a mechanical timer mechanism.

Further, there exists a problem in that the conventional sheet conveying apparatus has difficulties in separately mounting a delivery roller for discharging paper sheets due to its structure. That is, in the case where the delivery roller is mounted, paper sheets are conveyed in the reverse direction since the delivery roller rotates in a reverse direction when the motor rotates in the reverse direction. Therefore, a problem occurs in that it becomes impossible to discharge paper sheets.

In addition, there is a further problem in that the conventional sheet conveying apparatus has its limitations as to the capacity and speed for processing image information since it is difficult to deliver sheets at a high speed with the exclusion of the delivery roller, the driving of which is controlled separately from the sheet separation roller and the CS roller.

SUMMARY OF THE INVENTION

The present invention has been developed to improve the sheet conveying apparatus for the above conventional image information processor in consideration of its problems, and thus it is an object of the present invention to provide a sheet conveying apparatus for an image information processor capable of enhancing accuracy as to skew-feed corrections through control of changing sheet conveying speeds and also adjusting image resolutions.

It is another object of the present invention to provide a sheet conveying apparatus for an image information processor which can be usefully employed to convey a large capacity of sheets at a high speed with an increased sheet discharge efficiency by mutually connecting and driving a driving unit for conveying sheets in selective combinations.

In order to achieve the above objects, a sheet conveying apparatus for an image information processor has a sheet conveying unit, disposed on a sheet conveying path provided between a sheet supply opening and a sheet discharge opening, for conveying a sheet in one direction, and a driving unit for driving the sheet conveying unit. The sheet conveying apparatus according to the present invention comprises the sheet conveying unit including a sheet separation roller, a sheet registration roller, a scan roller, and a sheet delivery roller disposed in order for rotation on the sheet conveying path. The driving unit includes a driving motor controlled to change driving modes thereof in the forward and reverse directions, and a driving device for receiving a driving force from the driving motor, and for selectively performing combined driving of the sheet separation roller, the sheet registration roller, the scan roller, and the sheet delivery roller in mutual operations thereof according to a sheet conveying process which utilizes a driving force of the driving motor.

According to the present invention, the driving unit preferably includes a power switching device for selectively transferring a rotational force to a first power transmission system or a second power transmission system according to the driving modes of the driving motor, a plurality of driving gears coaxially mounted on rotation shafts of the sheet separation roller, sheet registration roller, scan roller and sheet delivery roller for connection to the first and second power transmission systems, and a power cutoff unit for cutting off power by selectively restraining the driving gears mounted to the rotation shafts of the sheet separation roller and the sheet registration roller.

Further, the power switching device preferably includes first and second power switching gears connected to an output shaft of the driving motor, and first and second cam gears linearly movable in the rotation shaft directions of the first and second power switching gears so as to move forward and backward in opposite directions to each other according to the driving modes of the forward and reverse directions.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE PREFERRED EMBODIMENT

Hereinafter, a sheet conveying apparatus for an image information processor according to an embodiment of the present invention will be described in detail with reference to the accompanying drawings.

Figure 1:
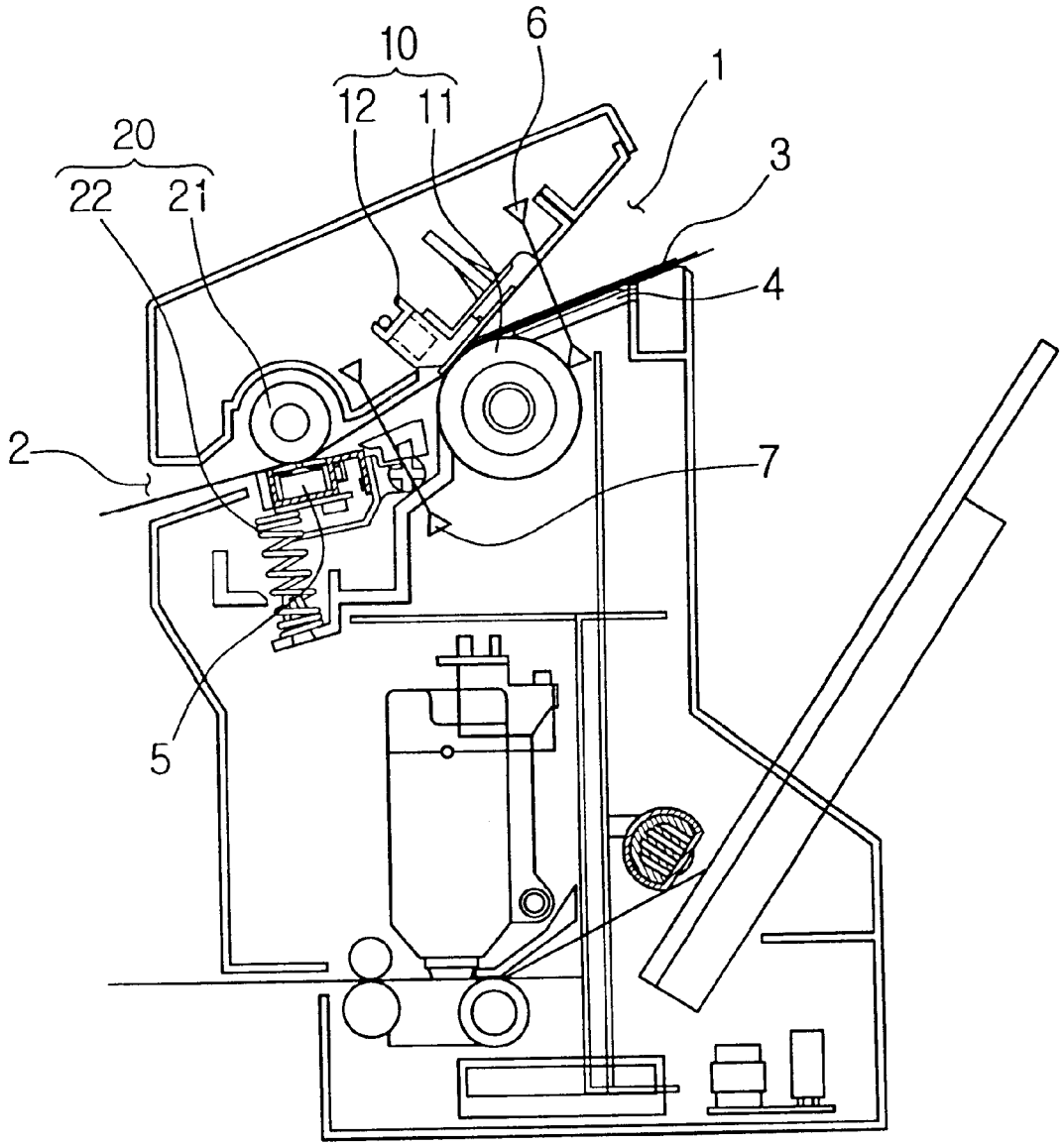
FIG. 1 (PRIOR ART)
FIG. 1 is a cross-sectioned view schematically showing the structure of a sheet conveying apparatus for an image information processor.

FIG. 1 is a view schematically showing an example of a sheet conveying apparatus for an image information processor having a sheet skew-feed correction capability, as disclosed in detail in Iwata et al. '570. As shown in FIG. 1, the sheet conveying apparatus for an image information processor includes a sheet separation roller 11 and a sheet guide 12 oppositely mounted above and below the sheet feed path to separate plural paper sheets 3 stacked on a sheet stacking plate 4 one by one, and to convey the sheets to an image reader 5.

The image reader 5, as shown in FIG. 1, reads image information on the sheet as an analog signal through an image reading sensor (not shown), and converts the read image information into a digital signal for output at a state wherein the image reader 5 is elastically biased upward by a spring so as to be in close contact with a CS roller 21 oppositely mounted at an upper portion. The CS roller 21 discharges the paper sheet from which the image reading is completed. Here, an undesignated reference numeral 6 of FIG. 1 denotes a sheet presence/absence detection sensor 6 for sensing the presence and absence of paper sheets loaded in the sheet stacking plate 4 and for outputting the information as to the sensed state as a signal. Reference numeral 7 denotes a sheet leading end detection sensor for sensing the leading ends of paper sheets conveyed to the image reader 5 and for outputting the sensed information as a signal.

The sheet leading end detection sensor 7 outputs a control signal for matching an image reading area start point of a paper sheet with the time that the image reader 5 starts to read in image information, and outputs a control signal for changing the driving modes of a driving motor (not shown) from a forward direction to a reverse direction, or vice versa, to interactively drive the sheet separation roller 11 and the CS roller 21.

The sheet conveying apparatus having the above structure, as disclosed in detail in U.S. Pat. No. 5,749,570, aligns the leading ends of paper sheets by using the changes of the forward and reverse directions of the driving motor and a mechanical timer mechanism (delay means), to thereby correct the skew-feed of the paper sheets.

Figure 2:
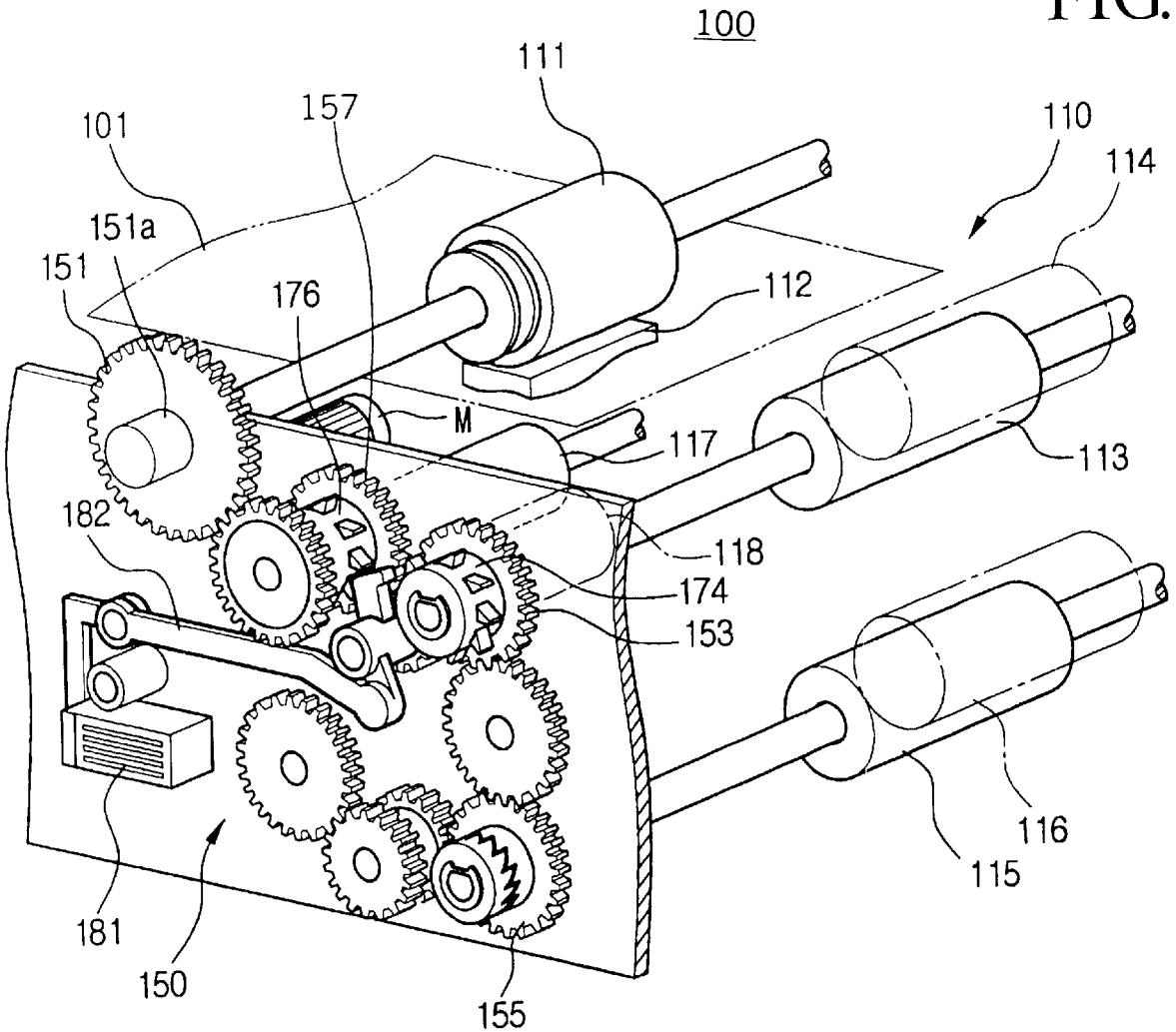
FIG. 2 is a view schematically showing the main structure of a sheet conveying apparatus for an image information processor according to an embodiment of the present invention.

FIG. 2 is a view schematically showing the main structure of a sheet conveying apparatus for an image information processor according to an embodiment of the present invention. In FIG. 2, a sheet conveying apparatus 100 for an image information processor according to an embodiment of the present invention includes a sheet conveying unit 110 provided on a path for conveying a sheet 101, and a driving unit 150 for driving the sheet conveying unit 110 by controlling an operation mode of the sheet conveying unit 110 according to conveyance progress of the paper sheet 101.

Figure 3:
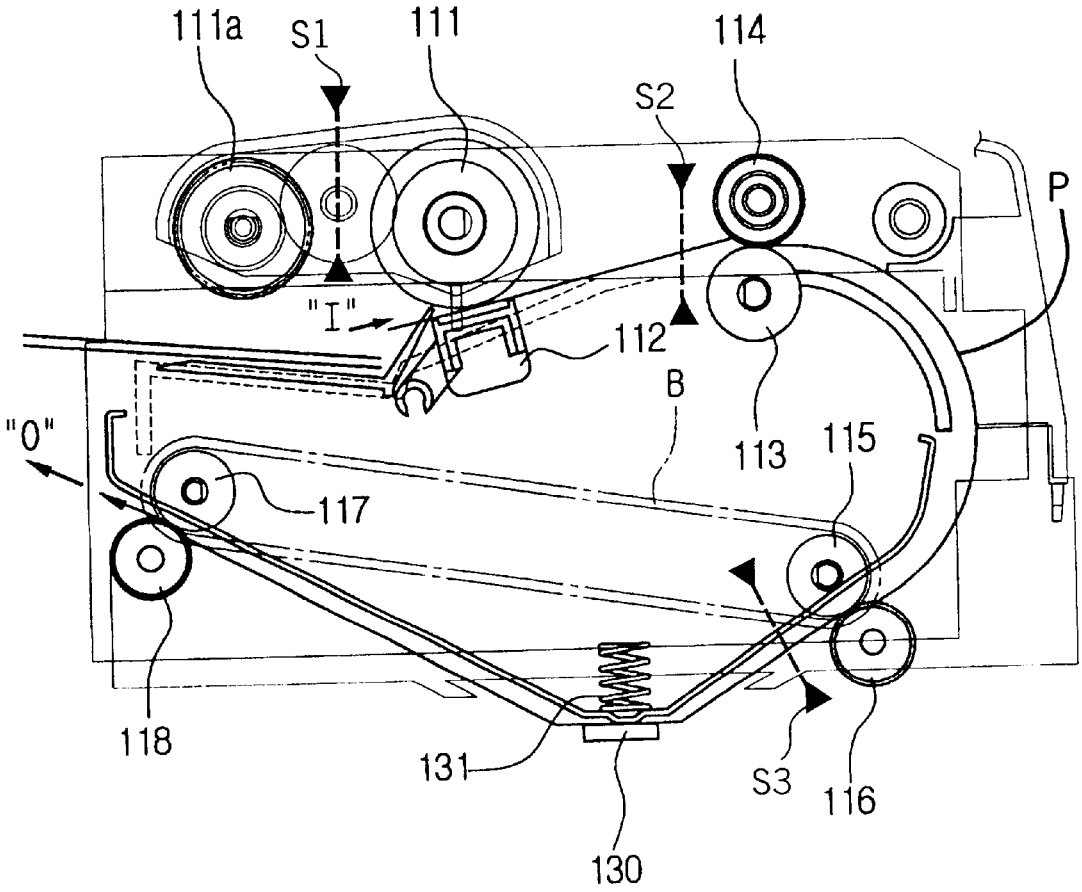
FIG. 3 is a view schematically showing the structure of a conveying unit in a sheet conveying apparatus for an image information processor according to an embodiment of the present invention.

FIG. 3 is a view schematically showing the structure of a conveying unit constituting a sheet conveying apparatus for an image information processor according to an embodiment of the present invention. In the sheet conveying apparatus 100 for an image information processor according to an embodiment of the present invention, as shown in FIG. 3, a sheet supply opening I and a sheet discharge opening O are formed above and below paths extending in the same direction. Further, a sheet conveying path P forms an opening curve in a "reverse C shape" which is an English alphabet "C" placing its left side right and its right side left on the drawing, to thereby connect the sheet supply opening I and the sheet discharge opening O.

The conveying unit 110, as shown in FIGS. 2 and 3, includes a sheet separation roller 111, a sheet registration roller 113, a scan roller 115, and a sheet delivery roller 117 successively arranged so as to be rotated on the sheet conveying path P from the sheet supply opening I to the sheet discharge opening O. In this case, reference numeral 112 denotes a sheet separation guide for separating paper sheets conveyed one by one by mutual operation with the sheet separation roller 111 one by one. Further, reference numerals 114, 116, and 118 denote idle rollers mounted in correspondence to the sheet registration roller 113, scan roller 115, and sheet delivery roller 117, respectively, so as to be passively driven.

The sheet registration roller 113 and the idle roller 114 restrain the leading end of a paper sheet entering the image reader (reference numeral 130 of FIG. 3), control the conveyance timing, and correct the skew-feed of the sheet, to thereby convey the sheet to the image reader in an aligned state.

A reference numeral 111*a* of FIG. 3, not described, denotes a sheet supply roller mounted to be passively driven by the sheet separation roller 111. The letter "B" denotes a belt connecting the scan roller 115 and the sheet delivery roller 117. Further, a reference numeral S1 denotes a sheet presence/absence detection sensor for sensing the presence and absence of a paper sheet loaded in a sheet stacking plate (not shown), and reference numeral S2 denotes a sheet detecting sensor for detecting the leading end of a paper sheet conveyed from the upstream of the sheet registration roller 113 and outputting a control signal for controlling the driving timing of the sheet registration roller 113. A loop formed as the leading end of a paper sheet is restrained in such a state that the registration roller 113 stops. In this state, the skew-feed of the paper sheet is corrected as the sensor S2 outputs a control signal for driving the registration roller 113 with a time difference. Further, a sensor S3 detects the leading end of the paper sheet conveyed in a state of skew-feed corrected by the registration roller 113, and then outputs a control signal for matching an image reading area start point with the time that the image reader 130 starts to read image information.

According to the present invention, the sensors S1, S2, and S3, for example, may be a non-contact-type sensor such as a photo sensor, a contact-type sensor such as a rotating lever which operates a solenoid by contacting the leading end of a paper sheet as the sheet is conveyed, or the like.

The image reader 130 reads in the analog image information of a paper sheet, and converts the read information into digital image information. Image reader 130 is mounted so as to be elastically biased in one direction by a spring 131 for forming a nip between the image reader 130 and a CS bar or a CS roller.

Figure 4:
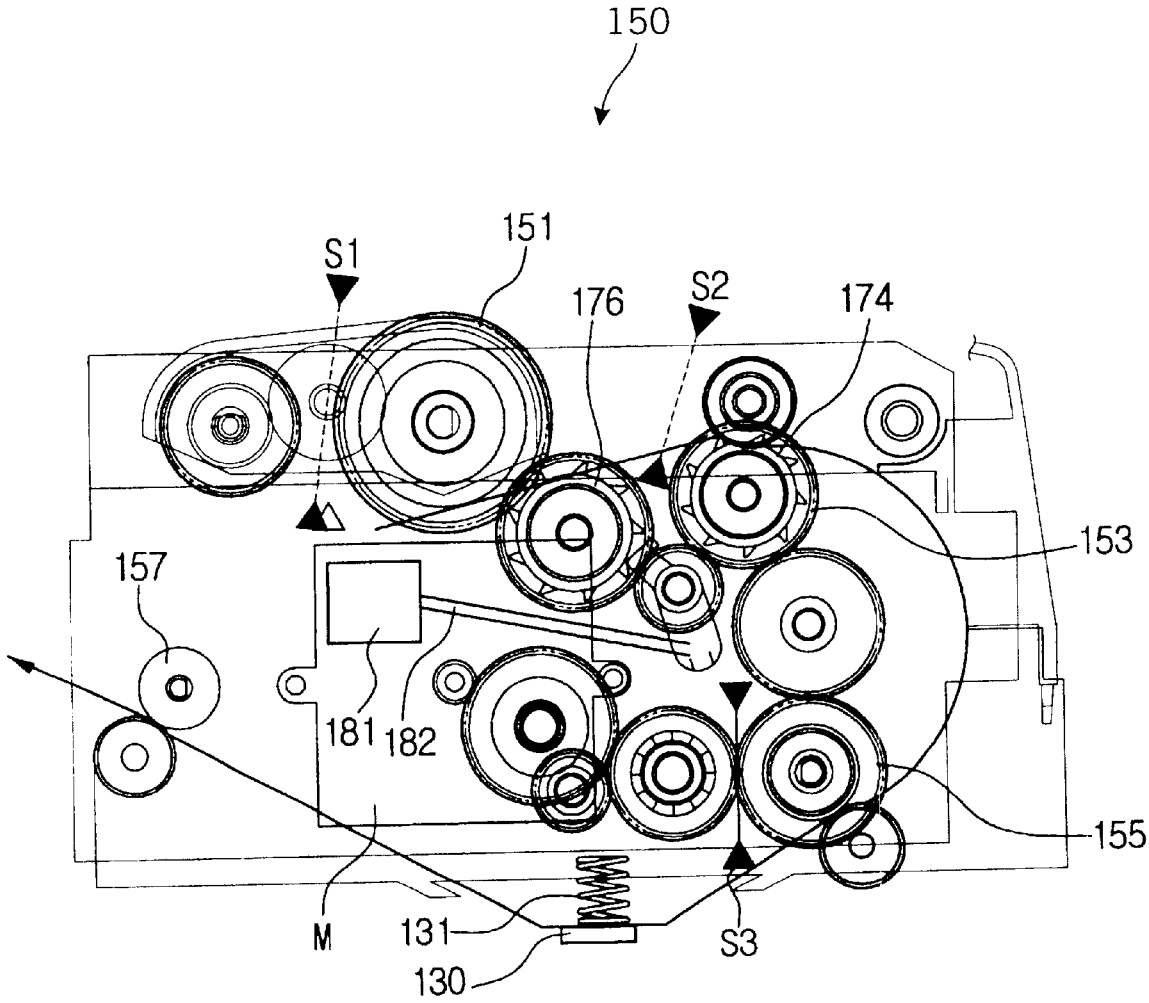
FIG. 4 is a view schematically showing the structure of a driving unit in a sheet conveying apparatus for an image information processor according to an embodiment of the present invention.
Figure 5:
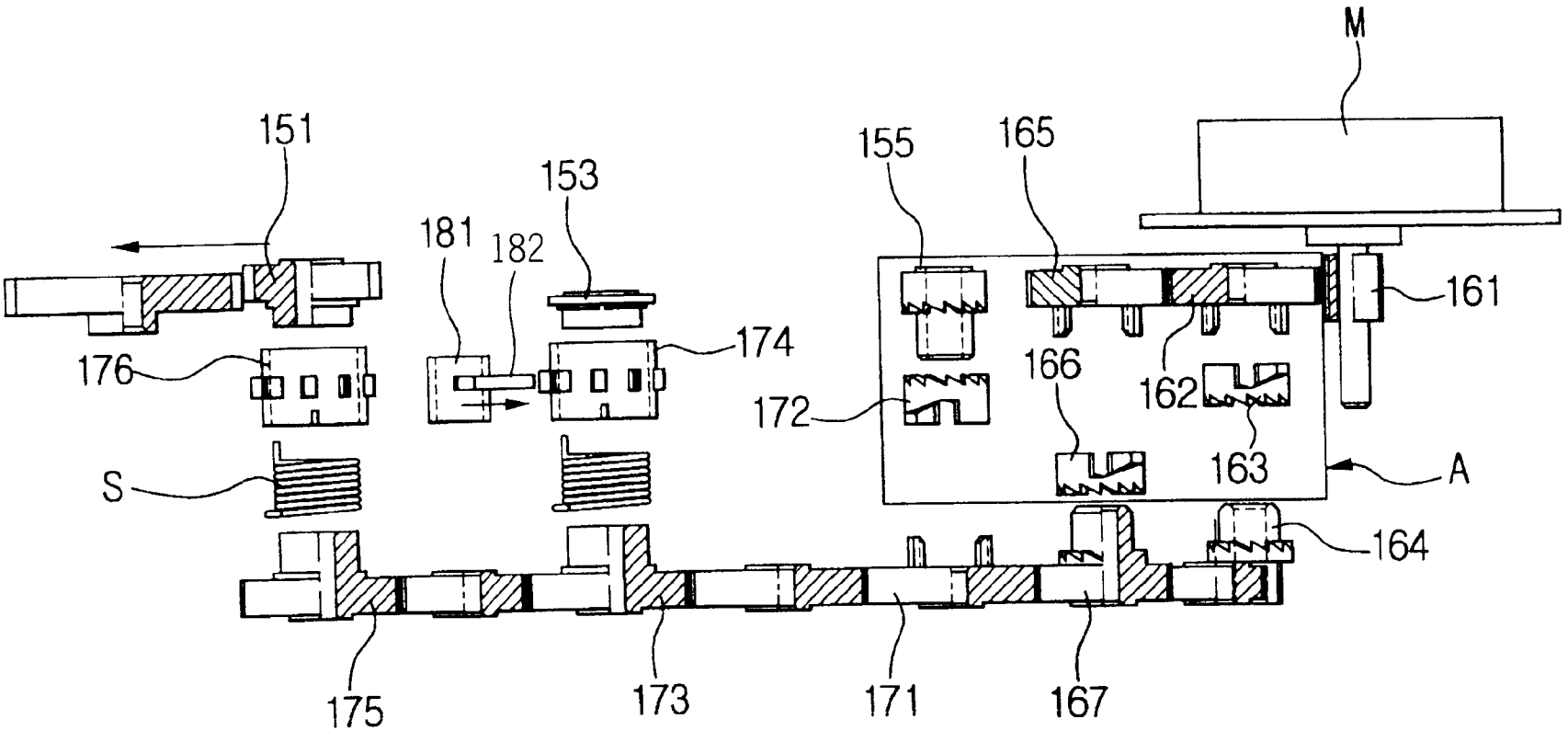
FIG. 5 is an exploded expansion view schematically showing a plane arrangement structure with the driving unit of FIG. 4 expanded in a power transmission direction.

FIG. 4 is a view schematically showing the structure of a driving unit constituting a sheet conveying apparatus for an image information processor according to an embodiment of the present invention, and FIG. 5 is an exploded expansion view schematically showing a plane arrangement structure with the driving unit of FIG. 4 expanded in a power transmission direction.

The present invention is characterized by the driving unit 150. As shown in FIGS. 2 and 4, the driving unit 150 includes plural driving gears that are mounted so as to be meshed with each other, and FIG. 5 is a view showing the interconnections of the plural driving gears that are developed in a power transmission direction. As shown in FIGS. 2, 4, and 5, the driving unit 150 includes a sheet separation roller gear 151, a sheet registration roller gear 153, a scan roller gear 155, and a sheet delivery roller gear 157 coaxially mounted on the rotating shafts of the sheet separation roller 111, sheet registration roller 113, scan roller 115, and sheet delivery roller 117, respectively. Reference numeral 151 a of FIG. 2 denotes a clutch unit for rotating the sheet separation roller 111 only in one direction.

Further included are a driving motor M and a power switching device A (FIG. 5). The driving motor M changes its driving modes to forward and reverse directions as a driving source for transmitting a driving force to the sheet separation roller gear 151, sheet registration roller gear 153, scan roller gear 155, and sheet delivery roller gear 157, respectively, and the power switching device A transmits a rotational force by selecting one of a first power transmission system for transmitting the rotational force to the sheet registration roller 113, and a second power transmission system for transmitting the rotational force to the sheet separation roller 111, scan roller 115, and sheet delivery roller 117 according to the driving mode of the driving motor M.

The power switching device A, as shown in FIG. 5, includes a first power switching gear 162 mounted to be meshed with a pinion gear 161 provided at the output shaft end of the driving motor M, a second power switching gear 165 mounted to be meshed with the first power switching gear 162, and first and second cam gears 163 and 166 mounted to travel forward and backward in an opposite manner in a rotation-axis direction according to the rotation directions of the first and second power switching gears 162 and 165.

Figure 6:
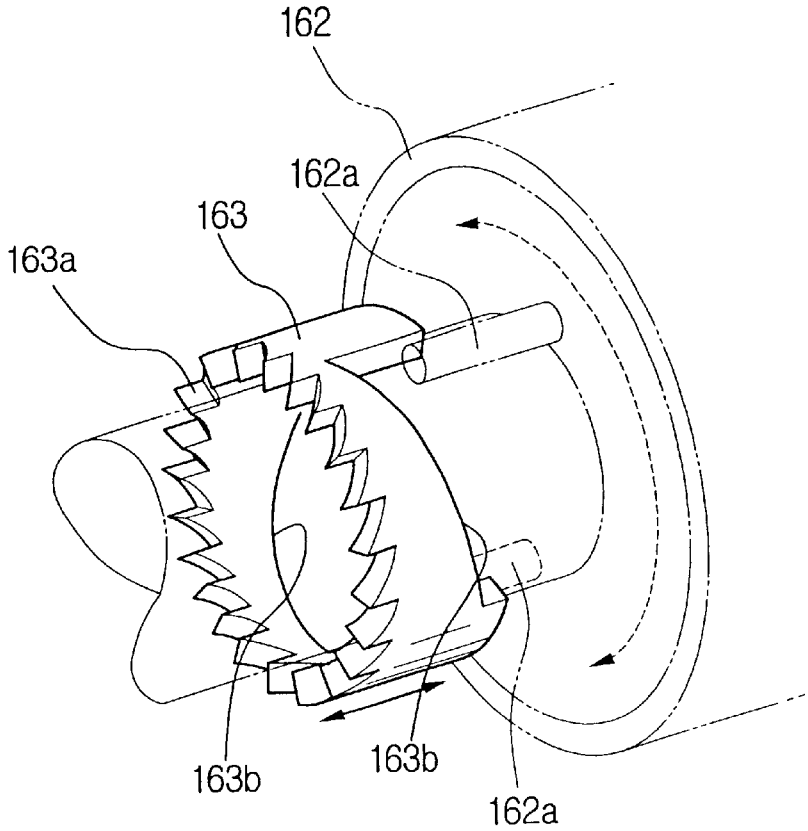
FIG. 6 is a perspective view schematically showing a main part of a power switching device of the driving unit of FIG. 5.

FIG. 6 is a perspective view schematically showing a main part of a power switching device of the driving unit of FIG. 5. More specifically, FIG. 6 schematically shows the interconnection of the first power switching gear 162 and the first cam gear 163. The interconnection of the second power switching gear 165 and the second cam gear 166 is substantially the same as that shown in FIG. 6. As shown in FIG. 6, the first cam gear 163 has a gear portion 163*a* with a toothed part formed in a clockwise or a counterclockwise direction at its front portion, and a pair of cam curve portions 163*b* curved in opposite directions at its rear portion. Further, a pair of cam pins 162*a* protrude from one side of the body of the first power switching gear 162, which constrains the curve portions 163*b* of the first cam gear 163 so as to follow the cam.

Accordingly, the cam pins 162*a* travel along the cam curve portions 163*b* of the first cam gear 163 according to a rotation direction of the first power switching gear 162, so that the first cam gear 163 moves forward and backward in the rotation axis direction of the first power switching gear 162.

The first power transmission system is for transmitting a rotational force to the sheet registration roller 113 according to a driving mode of the driving motor M, including the first connecting gear 164 selectively connected to the second cam gear 163.

The second power transmission system is for transmitting a rotational force to the sheet separation roller 111, scan roller 115 and sheet delivery roller 117 according to a driving mode of the driving motor M, including a second connecting gear 167 selectively connected to the second cam gear 166 and connected to the first connecting gear 164.

Further, in the first and second power transmission systems, a third power switching gear 171 is connected to the second connecting gear 167, and a third cam gear 172 selectively connected to the scan roller gear 155 is connected to the third power switching gear 171. The third power switching gear 171 and the third cam gear 172 have substantially the same structure as the first power switching gear 162 and the first cam gear 163 shown in FIG. 6, and the gear portions thereof are formed in opposite directions as to the first and second cam gears 163 and 166, respectively.

Relay gears 173 and 175 coaxially connected to the sheet registration roller gear 153 and the sheet separation roller gear 151, respectively, are successively connected to the third power switching gear 171.

Clutch gears 174 and 176, in which coil springs are built, are provided between the sheet registration roller gear 153 and the relay gear 173 and between the sheet separation roller gear 151 and the relay gear 175, respectively, and the clutch gears 174 and 176 are selectively restrained by their toothed outer circumference being locked in a stopper lever 182 operated by a solenoid 181 (see FIG. 2, FIG. 4 and FIG. 5).

Operation of the sheet conveying apparatus for an image information processor having the above structure will be described in detail with reference to the attached drawings.

FIGS. 7 thru 10 are schematic views used to explain operational states when in a forward direction driving mode of the driving motor of the sheet conveying apparatus for an image information processor according to an embodiment of the present invention.

Figure 7:
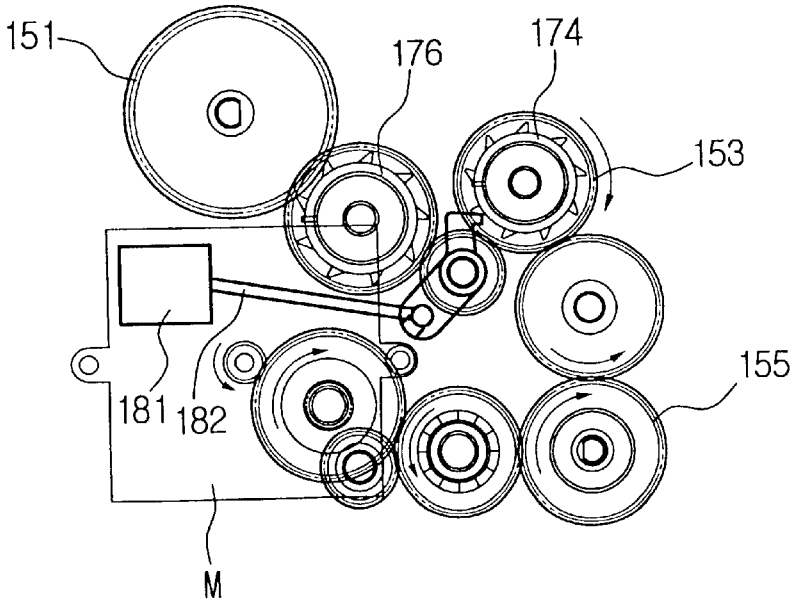
FIGS. 7 thru 10 are schematic views used to explain operation states when in a forward direction driving mode of a driving motor of a sheet conveying apparatus for an image information processor according to an embodiment of the present invention.
Figure 8:
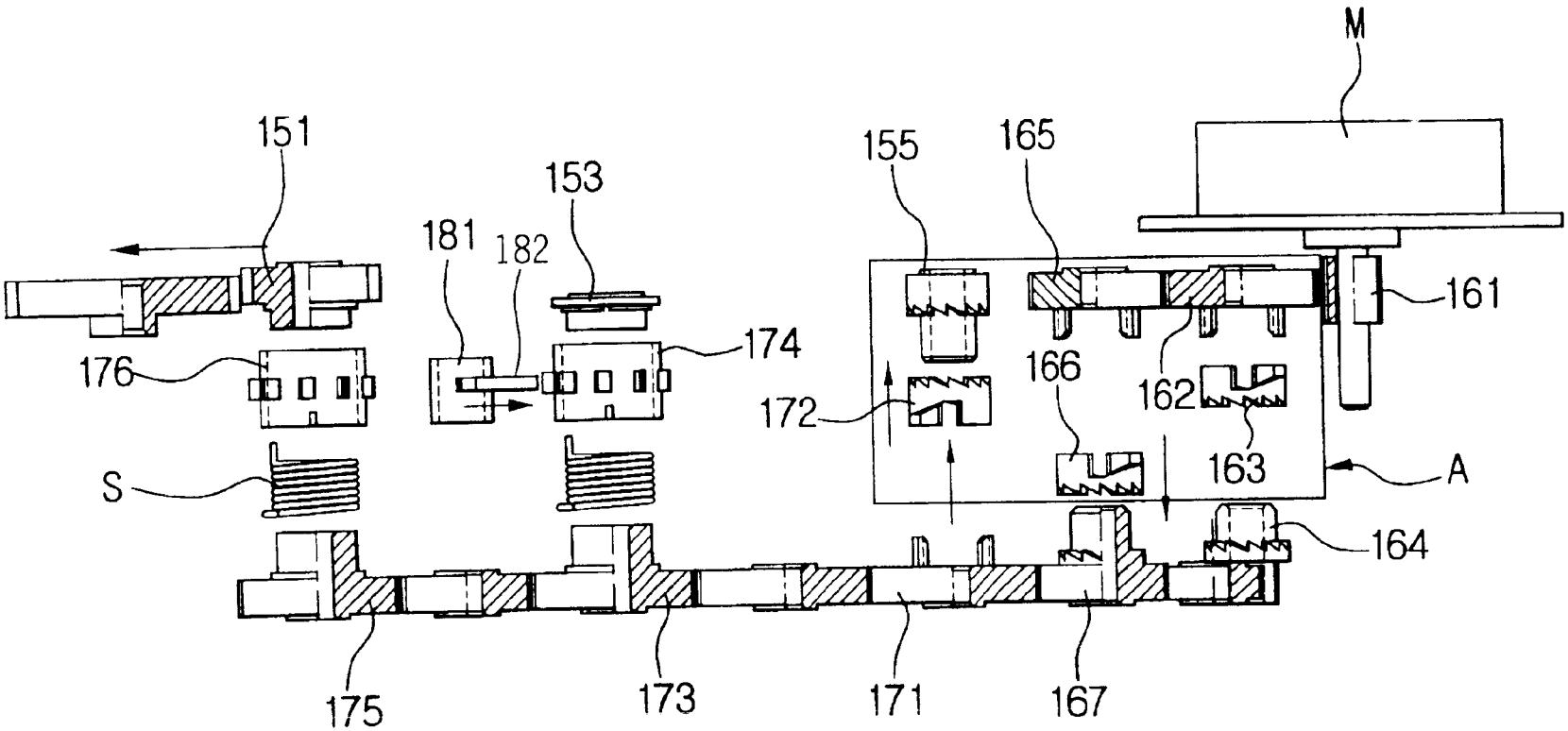

Specifically, FIGS. 7 and 8 are views showing sheet supply operations in a high speed mode. Referring to FIGS. 7 and 8, if a driving mode is selected by manipulating a control panel of the image information processor, the first and second power switching gears 162 and 165 are driven together with a worm gear 161 as the driving motor M is driven in the forward direction (in the counterclockwise direction). At this time, the first cam gear 163 is separated from the first connecting gear 164, and the second cam gear 166 is connected to the second connecting gear 167, so that the third power switching gear 171 and the relay gears 173 and 175, successively connected to the second connecting gear 167, are rotated.

Furthermore, as the third power switching gear 171 rotates, the third cam gear 172 is connected to the scan roller gear 155 so as to rotate the scan roller 115, and the relay gears 173 and 175 transfer power to the sheet registration roller gear 153 and the sheet separation roller gear 151, respectively, through the clutch gears 174 and 176, respectively.

However, the clutch gear 174 cuts off a rotational force and prevents it from being transferred to the sheet registration roller gear 153 by operation of the stopper lever 182 connected to the solenoid 181 so that the sheet registration roller 113 (FIG. 3) remains still. Further, the sheet delivery roller 117 connected by a belt B to the scan roller 115 rotates in unison with the rotation of the scan roller 115 (FIG. 3).

That is, during the sheet supply operation as described above, the scan roller 115 and the delivery roller 117 remain in a no-load operation as an initial stage at which sheet conveyance starts by means of the sheet separation roller 111, whereas the sheet registration roller 113 remains still since the power of the driving motor M is cut off by the switch unit A (FIG. 5).

In the above state, a loop occurs since sheet 101 is conveyed further while the leading end of the sheet 101 is restrained by the sheet registration roller 113 and the idle roller 114 which are in the stationary state (FIGS. 2 and 3).

In the sheet conveyance step as stated above, the sheet detecting sensor S2 (FIGS. 3 and 4) detects the leading end of the paper sheet 101 (FIG. 2) and outputs a signal. Based on that signal, the sheet registration roller 113 and the idle roller 114 are controlled in a stationary state for a certain period of time to delay the sheet conveyance progress for the certain period of time, thereby aligning the leading end of the paper sheet 101 at which a loop has occurred.

Figure 9:
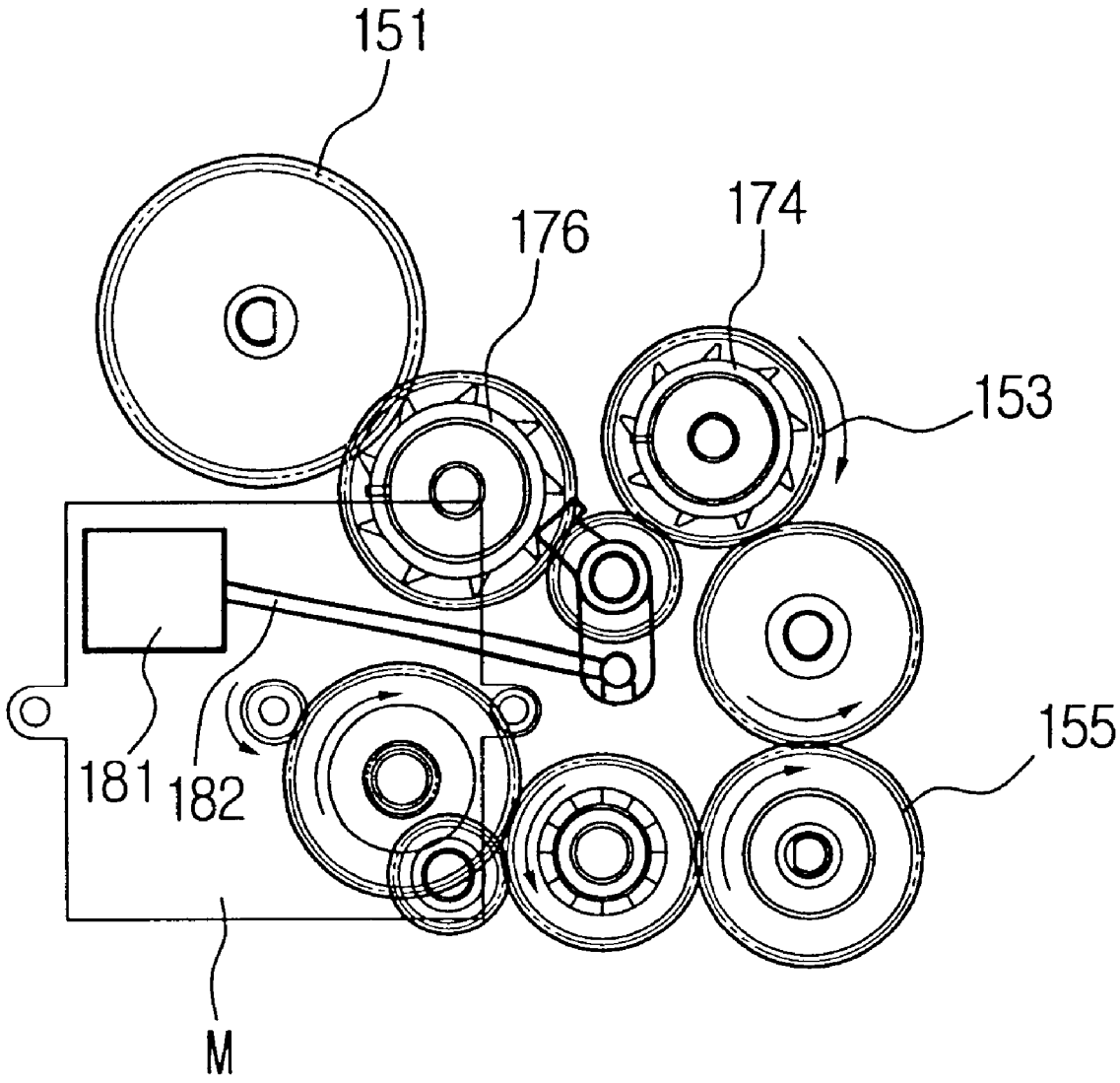
Figure 10:
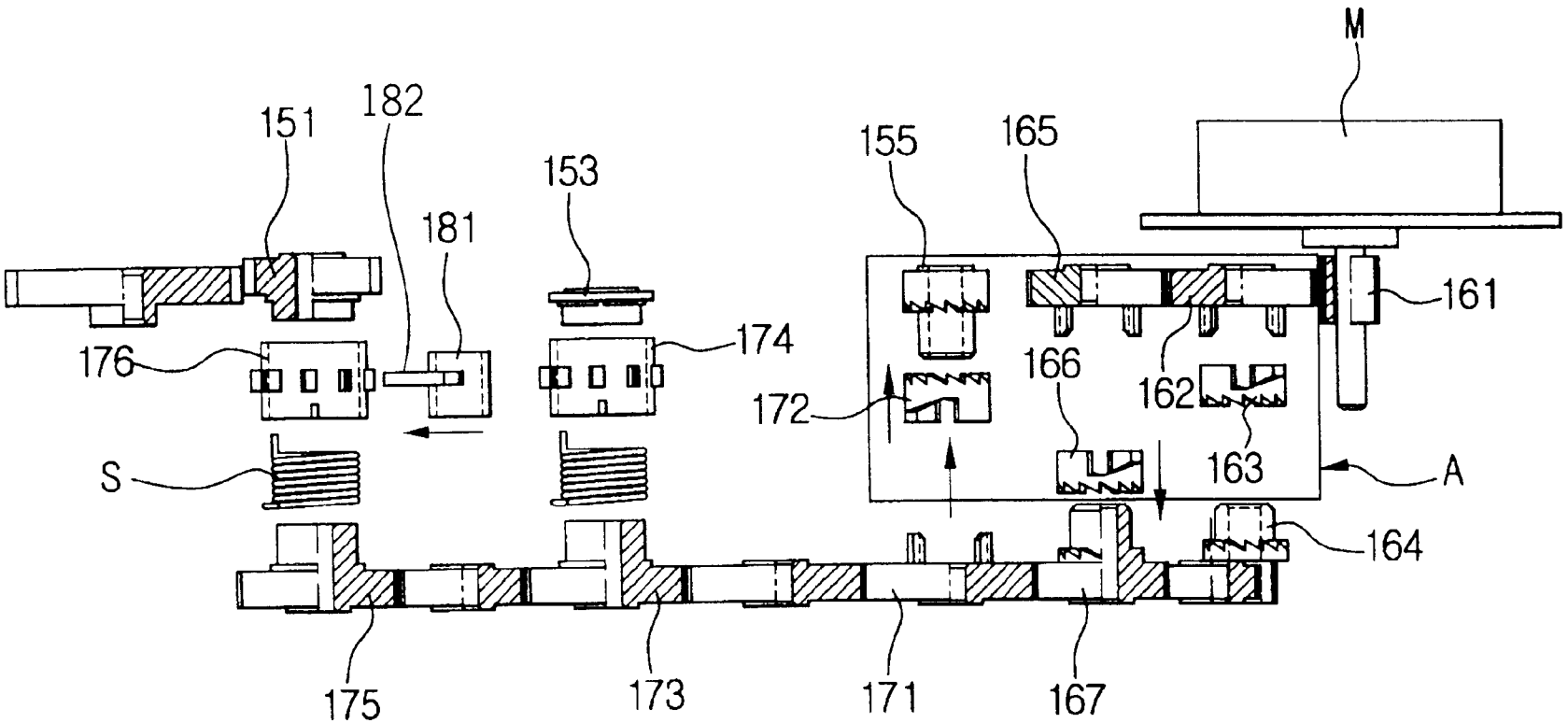

If the paper sheet 101 conveyed by the above sheet supply operation is restrained by the sheet registration roller 113 and the idle roller 114, and then a certain period of time lapses in a temporarily stopped state, the solenoid 181 (FIGS. 2 and 4) reverses the direction of the stopper lever 182 based on the output signal of the sensor S1 (shown in FIGS. 9 and 10). Accordingly, the restrained state of the clutch gear 174 is released to transmit rotational force to the sheet registration roller gear 153, so that the sheet registration roller 113 starts to rotate. At the same time, the clutch gear 175 prevents the rotational force from being transmitted to the sheet separation roller gear 151 by the restraint of the stopper lever 182, so that the sheet separation roller 111 becomes temporarily stopped, and then the supply of a new paper sheet is temporarily stopped.

Accordingly, the paper sheet 101 is conveyed to the image reader 130, and, during the conveyance of the paper sheet 101, the sheet detecting sensor S3 detects the leading end of the paper sheet 101 conveyed in a state of skew-feed corrected by the sheet registration roller 113 and the idle roller 114, and outputs a control signal for matching an image reading area start point with the image information reading time of the image reader 130. After the image reading has been completed, the paper sheet 101 is discharged by the rotational force of the scan roller 115 and the delivery roller 117.

FIGS. 11 thru 14 are schematic views used to explain operational states when in a reverse direction driving mode of the driving motor of the sheet conveying apparatus for an image information processor according to an embodiment of the present invention.

Figure 11:
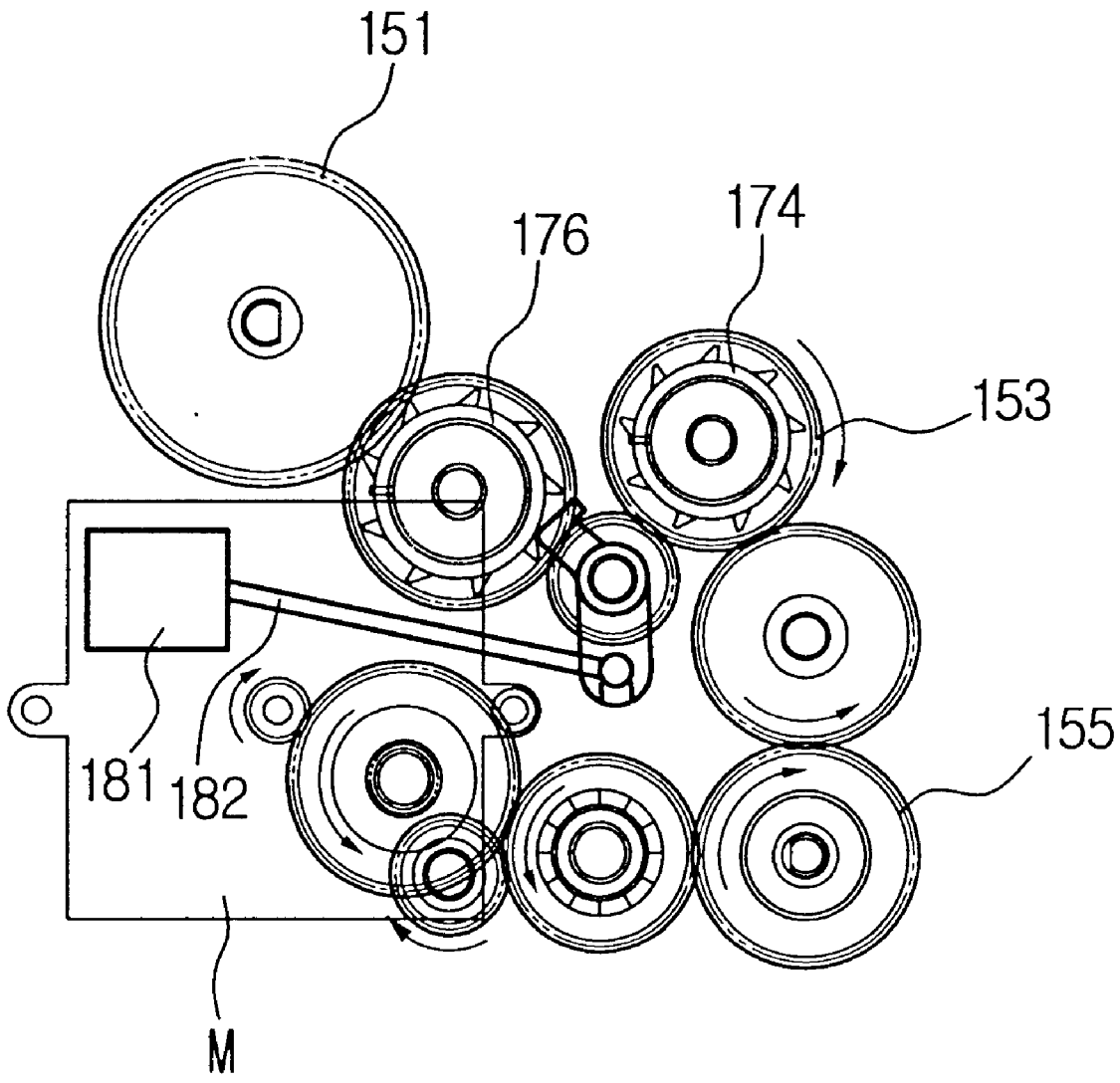
FIGS. 11 thru 14 are schematic views used to explain operation states of a driving motor of a sheet conveying apparatus for an image information processor operating in a reverse direction driving mode according to an embodiment of the present invention.
Figure 12:
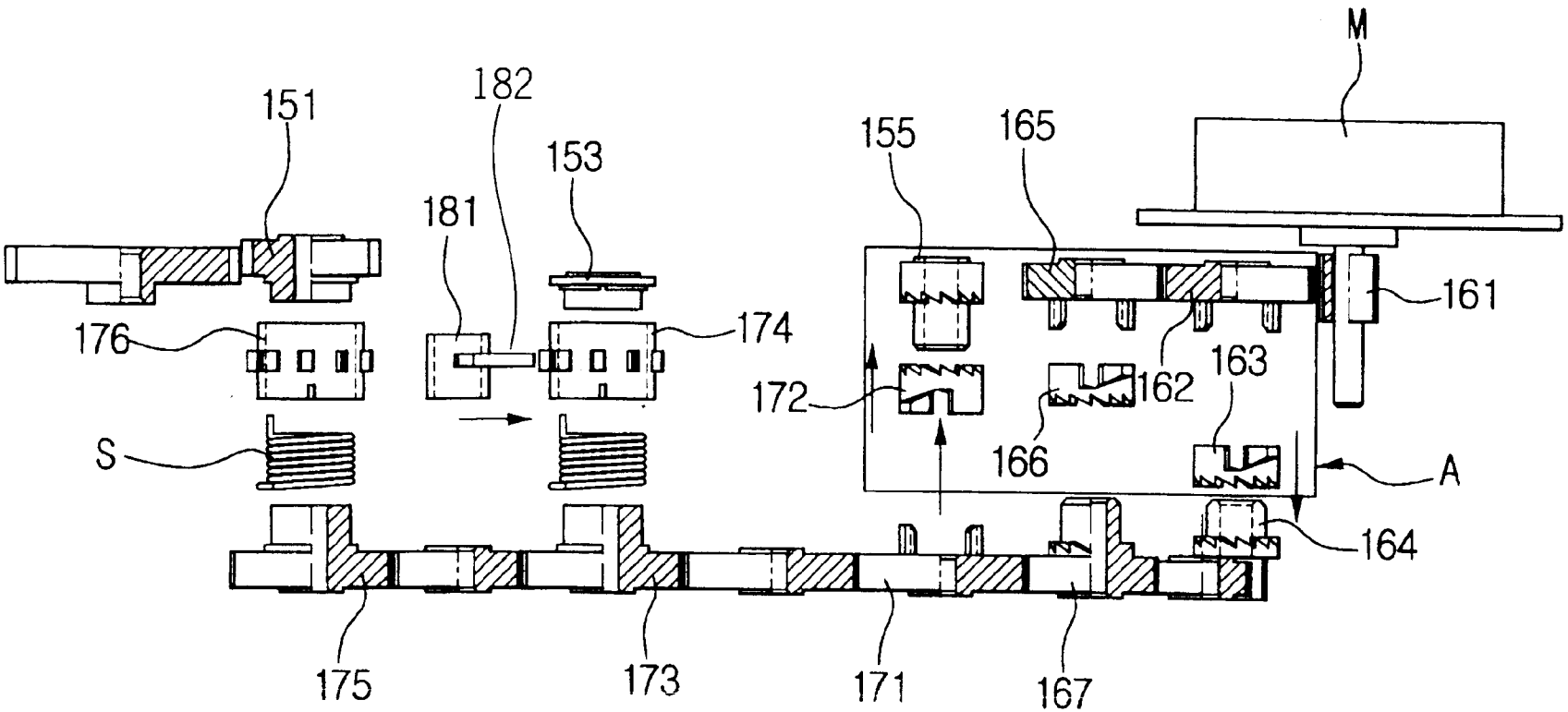

FIGS. 11 and 12 are views showing sheet supply operations in a low speed mode. As shown in FIGS. 11 and 12, if a driving mode is selected by manipulating a control panel (not shown) of the image information processor, the pinion gear 161 and the first and second power switching gears 162 and 165, respectively, are driven to rotate as the driving motor M is driven in a reverse direction (clockwise direction). At this point, the second cam gear 166 is separated from the second connecting gear 167, and the first cam gear 163 is connected to the first connecting gear 164, so that the second connecting gear 167, the third power switching gear 171, and the relay gears 173 and 175 successively connected to the first connecting gear 164 are rotatably driven.

Furthermore, as the third power switching gear 171 rotates, the third cam gear 172 is connected to the scan roller gear 155 so as to rotate the scan roller 115, and the relay gears 173 and 175 transmit power to the sheet registration roller gear 153 and the sheet separation roller gear 151 through the respective clutch gears 174 and 176.

However, the clutch gear 174 prevents a rotational force from being transferred to the sheet registration roller gear 153 by the operation of the stopper lever 182 connected to the solenoid 181 so that the sheet registration roller 113 remains in a stationary state. Further, a sheet delivery roller 117 (FIG. 3), connected to the scan roller 115 by a belt B, operates in unison with the rotational force of the scan roller 115.

That is, in the sheet supply operation as described above, the scan roller 115 and the sheet delivery roller 117 remain in a no-load operation in an initial stage in which sheet conveyance starts by means of the sheet separation roller 111, whereas the sheet registration roller 113 remains stationary with the power of the driving motor M cut off by the power switching device A.

In the above state, as the sheet supply proceeds further, the leading end of the paper sheet 101 is restrained by the sheet registration roller 113 and the idle roller 114 in stationary states so that a loop occurs.

In the above sheet conveyance process, the sheet detecting sensor S2 detects the leading end of the paper sheet 101, and outputs a signal. Based on that signal, the sheet registration roller 113 and the idle roller 114 are controlled to remain in the stationary state for a certain period of time, thereby to delay sheet conveyance for the certain period of time and to align the leading end of the paper sheet 101 at which the loop has occurred.

Figure 13:
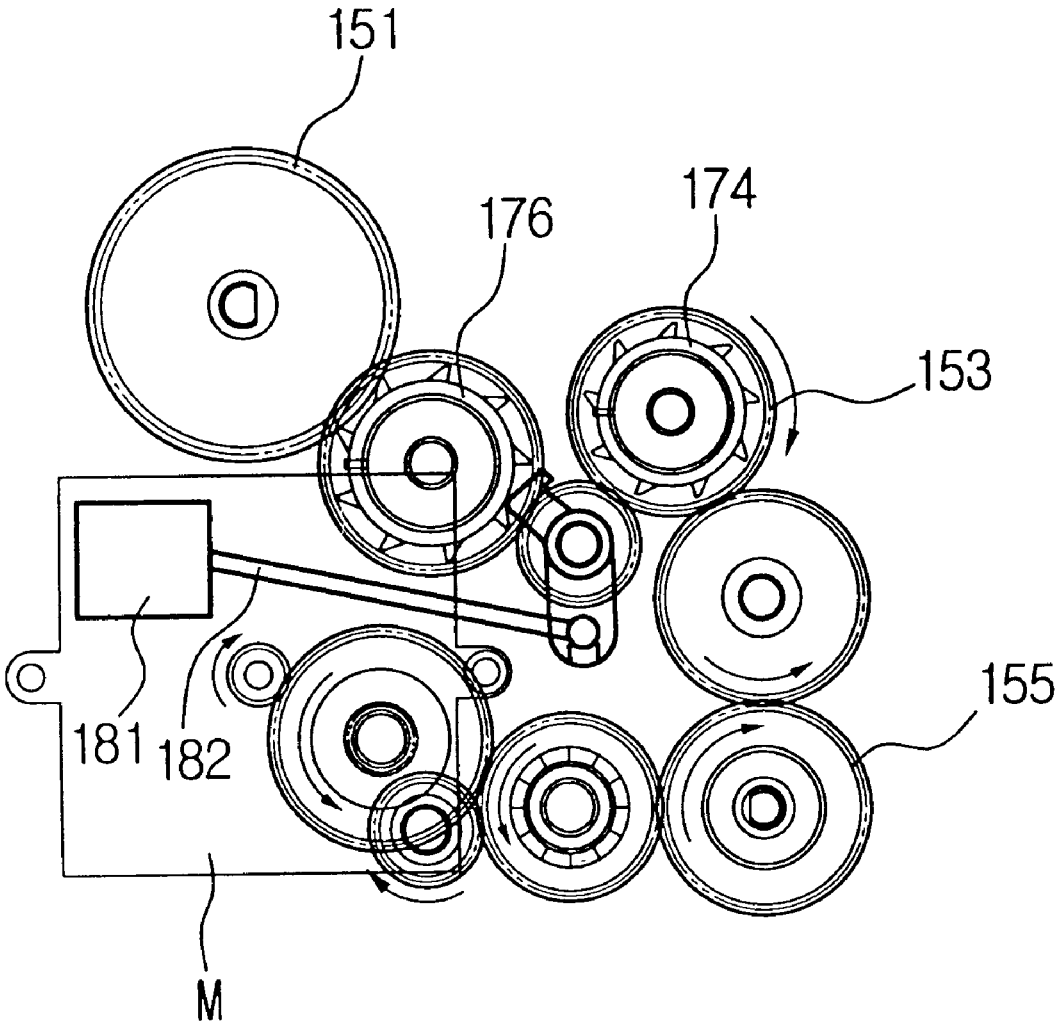
Figure 14:
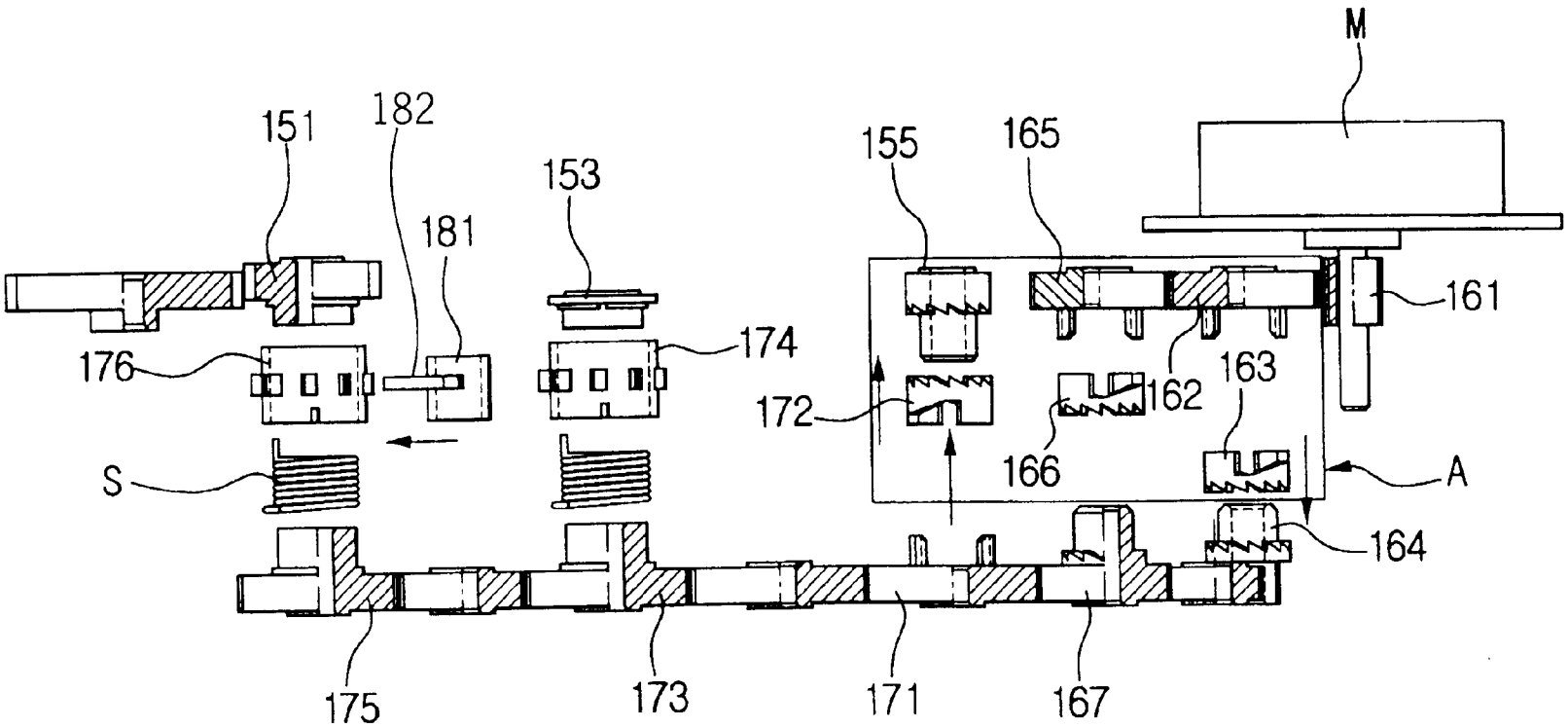

If a sheet conveyed through the above sheet supply operation is restrained by the sheet registration roller 113 and the idle roller 114, and a certain period of time elapses in a temporarily stopped state, the solenoid 181 (FIGS. 2 and 4) reverses the direction of the stopper lever 182, as shown in FIGS. 13 and 14, based on an output signal of the sensor S1. Accordingly, the restrained state of the clutch gear 174 is released so as to transfer a rotational force to the sheet registration roller gear 153 so that the sheet registration roller 113 starts to rotate. At the same time, the clutch gear 175 prevents the rotational force from being transferred to the sheet separation roller gear 151 by the restraint of the stopper lever 182, so that the sheet separation roller 111 assumes a stationary state so as to temporarily stop the supply of new sheets.

Accordingly, the sheet 101 is conveyed to the image reader 130, and, during the sheet conveyance process, the sheet detecting sensor S3 detects the leading end of the paper sheet 101 conveyed in a state of corrected skew-feed by the sheet registration roller 113 and the idle roller 114, and outputs a control signal for matching an image reading area start point and the image information reading time of the image reader 130. After the image reading has been completed, the paper sheet 101 is discharged by the rotational force of the scan roller 115 and the delivery roller 117.

As stated above, in the operations of the sheet conveying apparatus for an image information processor according to the present invention, the scan roller 115 and the sheet delivery roller 117 rotate constantly regardless of a driving mode of the driving motor M and a driving state or a stationary state of the sheet stationary roller 113. Accordingly, a margin (a conveyance interval) between paper sheets can be minimized for a more efficient sheet supply at a high speed.

According to the present invention as stated above, since the alignment of the leading end of the paper sheet 101 and the skew-feed correction are realized with the use of a gear train of simple structure, instead of the use of a time delay mechanism having a complex structure and a stringent requirement for accuracy, reliability can be obtained, even in the case of automatic supply of a large capacity of sheets at high speed.

Furthermore, with the scan roller 115 and the delivery roller 117 additionally provided, smooth sheet discharges become possible, even in the case where the sheet supply capacity of the sheet insertion part and the stack capacity of the delivery part are large, and discharged sheets can be evenly stacked in order.

Furthermore, by variably controlling the sheet conveying speed with the driving motor driven in forward and reverse directions, the sheet conveying apparatus for an image information processor can enhance accuracy on the skew-feed correction of a sheet, and can also adjust image resolution.

Although a preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A sheet conveying apparatus for an image information processor, comprising:

a sheet conveying unit disposed on a sheet conveying path provided between a sheet supply opening and a sheet discharge opening for conveying a paper sheet in one direction;

a driving unit for driving the sheet conveying unit; and a sheet separation roller, a sheet registration roller, a scan roller, and a sheet delivery roller disposed on the sheet conveying path for rotation;

said driving unit including:

a driving motor controlled to change driving modes thereof in forward and reverse directions; and driving means for receiving a driving force of the driving motor, and for selectively performing combined driving of the sheet separation roller, the sheet registration roller, the scan roller, and the sheet delivery roller in mutual operations thereof, according to a sheet conveying process, with a driving force of the driving motor;

wherein said driving means includes a power switching device for selectively transferring a rotational force to one of a first power transmission system and a second power transmission system according to the driving mode of the driving motor; and wherein the power switching device includes:

first and second power switching gears connected to an output shaft of the driving motor; and first and second cam gears linearly movable in the rotation shaft directions of the first and second power switching gears so as to move forward and backward in opposite directions relative to each other according to the driving modes of the forward and reverse directions.

2. The sheet conveying apparatus of claim 1, wherein the driving means further includes:

a plurality of driving gears coaxially mounted on rotation shafts of the sheet separation roller, the sheet registration roller, the scan roller, and the sheet delivery roller, respectively, for connection to the first and second power transmission systems; and a power cutoff device for cutting off power by selectively restraining the driving gears mounted on the rotation shafts of the sheet separation roller and the sheet registration roller.

3. The sheet conveying apparatus of claim 2, wherein the first power transmission system includes:

a first connecting gear selectively connected according to linear movement of the first cam gear; and a plurality of relay gears connecting the plurality of driving gears to the first connecting gear.

4. The sheet conveying apparatus of claim 2, wherein the second power transmission system includes:

a second connecting gear selectively connected according to linear movement of the second cam gear; and a plurality of relay gears connecting the plurality of driving gears to the second connecting gear.

5. The sheet conveying apparatus of claim 4 wherein the power cutoff device includes:

clutch gears, each mounted between a respective one of the driving gear mounted on the rotation shaft of the sheet separation roller and the driving gear mounted on the rotation shaft of the sheet registration roller, on one side, and a respective one of the relay gears connecting the plurality of driving gears to the second connecting gear, on another side;

a stopper lever for cutting off power by restraining one of the clutch gears; and a solenoid for operating the stopper lever.

6. The sheet conveying apparatus of claim 4, wherein the power cutoff device includes:

clutch gears, each mounted between a respective one of the driving gear mounted on the rotation shaft of the sheet separation roller and the driving gear mounted on the rotation shaft of the sheet registration roller, on one side, and a respective one of the relay gears connecting the plurality of driving gears to the first connecting gear, on another side;

a stopper lever for cutting off power by restraining one of the clutch gears; and a solenoid for operating the stopper lever.

7. A sheet conveying apparatus for an image information processor, comprising:

sheet conveying means disposed on a sheet conveying path provided between a sheet supply opening and a sheet discharge opening for conveying a paper sheet in one direction;

driving means for driving the sheet conveying unit; and a plurality of rollers disposed on the sheet conveying path for rotation;

wherein said driving means comprises:

a driving motor controlled to change driving modes thereof in forward and reverse directions; and a driving unit for receiving a driving force of the driving motor, and for selectively performing combined driving of the plurality of roller in mutual operations thereof, according to a sheet conveying process, with a driving force of the driving motor;

wherein said driving unit includes a power switching device for selectively transferring a rotational force to one of a first power transmission system and a second power transmission system according to the driving mode of the driving motor; and wherein the power switching device includes:

first and second power switching gears connected to an output shaft of the driving motor; and first and second cam gears linearly movable in the rotation shaft directions of the first and second power switching gears so as to move forward and backward in opposite directions relative to each other according to the driving modes of the forward and reverse directions.

8. The sheet conveying apparatus of claim 7, wherein the driving unit further includes:

a plurality of driving gears coaxially mounted on respective rotation shafts of the plurality of rollers for connection to the first and second power transmission systems; and a power cutoff device for cutting off power by selectively restraining the driving gears mounted on the respective rotation shafts of the plurality of rollers.

9. The sheet conveying apparatus of claim 8, wherein the first power transmission system includes:

a first connecting gear selectively connected according to linear movement of the first cam gear; and a plurality of relay gears connecting the plurality of driving gears to the first connecting gear.

10. The sheet conveying apparatus of claim 8, wherein the second power transmission system includes:

a second connecting gear selectively connected according to linear movement of the second cam gear; and a plurality of relay gears connecting the plurality of driving gears to the second connecting gear.

11. The sheet conveying apparatus of claim 10, wherein the power cutoff device includes:

clutch gears, each mounted between a respective one of the driving gears mounted on the respective rotation shafts of the plurality of rollers, on one side, and a respective one of the relay gears connecting the plurality of driving gears to the second connecting gear, on another side;

a stopper lever for cutting off power by restraining one of the clutch gears; and a solenoid for operating the stopper lever.

12. The sheet conveying apparatus of claim 11, wherein said plurality of rollers includes a sheet separation roller and a sheet registration roller.

13. The sheet conveying apparatus of claim 9, wherein the power cutoff device includes:

clutch gears, each mounted between a respective one of the driving gears mounted on the respective rotation shafts of the plurality of rollers, on one side, and a respective one of the relay gears connecting the plurality of driving gears to the first connecting gear, on another side;

a stopper lever for cutting off power by restraining one of the clutch gears; and a solenoid for operating the stopper lever.

14. The sheet conveying apparatus of claim 13, wherein said plurality of rollers includes a sheet separation roller and a sheet registration roller.

15. The sheet conveying apparatus of claim 8, wherein said plurality of rollers includes at least two of a sheet registration roller, a sheet delivery roller, a sheet separation roller and a scan roller.

16. The sheet conveying apparatus of claim 15, wherein the plurality of rollers includes the sheet registration roller, the sheet delivery roller, the sheet separation roller and the scan roller, and wherein the first power transmission system transmits a rotational force to the sheet registration roller, and the second power transmission system transmits a rotational force to the sheet separation roller, the scan roller and the sheet delivery roller.

17. The sheet conveying apparatus of claim 8, wherein said plurality of rollers includes at least two of a sheet registration roller, a sheet delivery roller, a sheet separation roller and a scan roller.

18. The sheet conveying apparatus of claim 17, wherein the plurality of rollers includes the sheet registration roller, the sheet delivery roller, the sheet separation roller and the scan roller, and wherein the first power transmission system transmits a rotational force to the sheet registration roller, and the second power transmission system transmits a rotational force to the sheet separation roller, the scan roller and the sheet delivery roller.

19. A sheet conveying apparatus for an image information processor, comprising:

sheet conveying means disposed on a sheet conveying path provided between a sheet supply opening and a sheet discharge opening for conveying a paper sheet in one direction;

driving means for driving the sheet conveying unit; and a plurality of rollers disposed on the sheet conveying path for rotation;

wherein said driving means comprises:

a driving motor controlled to chance driving modes thereof in forward and reverse directions; and a driving unit for receiving a driving force of the driving motor, and for selectively performing combined driving of the plurality of roller in mutual operations thereof, according to a sheet conveying process, with a driving force of the driving motor;

wherein said plurality of rollers includes at least two of a sheet registration roller, a sheet delivery roller, a sheet separation roller and a scan roller.

20. The sheet conveying apparatus of claim 19, wherein the first power transmission system includes:

a first connecting gear selectively connected according to linear movement of the first cam gear; and a plurality of relay gears connecting the plurality of driving gears to the first connecting gear.

21. The sheet conveying apparatus of claim 19, wherein the second power transmission system includes:

a second connecting gear selectively connected according to linear movement of the second cam gear; and a plurality of relay gears connecting the plurality of driving gears to the second connecting gear.

22. The sheet conveying apparatus of claim 19, wherein said driving unit includes a power switching device for selectively transferring a rotational force to one of a first power transmission system and a second power transmission system according to the driving mode of the driving motor.

23. The sheet conveying apparatus of claim 22, wherein the power switching device includes:

first and second power switching gears connected to an output shaft of the driving motor; and first and second cam gears linearly movable in the rotation shaft directions of the first and second power switching gears so as to move forward and backward in opposite directions relative to each other according to the driving modes of the forward and reverse directions.

24. The sheet conveying apparatus of claim 19, wherein said driving unit includes a plurality of driving gears coaxially mounted on respective rotation shafts of the plurality of rollers for connection to the first and second power transmission systems.

25. The sheet conveying apparatus of claim 24, wherein said driving unit further includes a power cutoff device for cutting off power by selectively restraining the driving gears mounted on the respective rotation shafts of the plurality of rollers.

26. The sheet conveying apparatus of claim 25, wherein the power cutoff device includes:

clutch gears, each mounted between a respective one of the driving gears mounted on the respective rotation shafts of the plurality of rollers, on one side, and a respective one of relay gears connecting the plurality of driving gears to a connecting gear, on another side;

a stopper lever for cutting off power by restraining one of the clutch gears; and a solenoid for operating the stopper lever.

27. A sheet conveying apparatus for an image information processor, comprising:

sheet conveying means disposed on a sheet conveying path provided between a sheet supply opening and a sheet discharge opening for conveying a paper sheet in one direction;

driving means for driving the sheet conveying unit; and a plurality of rollers disposed on the sheet conveying path for rotation;

wherein said driving means comprises:

a driving motor controlled to change driving modes thereof in forward and reverse directions; and a driving unit for receiving a driving force of the driving motor, and for selectively performing combined driving of the plurality of roller in mutual operations thereof, according to a sheet conveying process, with a driving force of the driving motor;

wherein said driving unit includes a plurality of driving gears coaxially mounted on respective rotation shafts of the plurality of rollers for connection to a first power transmission system and a second power transmission system.

28. The sheet conveying apparatus of claim 27, wherein the first power transmission system includes:

a connecting gear selectively connected according to linear movement of a cam gear of a power switching device in said driving unit; and a plurality of relay gears connecting the plurality of driving gears to the connecting gear.

29. The sheet conveying apparatus of claim 28, wherein the driving unit further includes a power cutoff device which comprises:

clutch gears, each mounted between a respective one of the driving gears mounted on the respective rotation shafts of the plurality of rollers, on one side, and a respective one of the relay gears connecting the plurality of driving gears to the connecting gear, on another side;

a stopper lever for cutting off power by restraining one of the clutch gears; and a solenoid for operating the stopper lever.

30. The sheet conveying apparatus of claim 27, wherein said plurality of rollers includes at least two of a sheet registration roller, a sheet delivery roller, a sheet separation roller and a scan roller.

31. The sheet conveying apparatus of claim 30, wherein the plurality of rollers includes the sheet registration roller, the sheet delivery roller, the sheet separation roller and the scan roller, and wherein the first power transmission system transmits a rotational force to the sheet registration roller, and the second power transmission system transmits a rotational force to the sheet separation roller, the scan roller and the sheet delivery roller.

* * * * *